US006544101B1

(12) United States Patent
von Sydow et al.

(10) Patent No.: US 6,544,101 B1
(45) Date of Patent: Apr. 8, 2003

(54) BRASSIERE SUPPORT

(76) Inventors: Gabriel von Sydow, Artillerigatan 81, S-114 45 Stockholm (SE); Peter R. Lofgren, Brahegatan 48, S-114 37 Stockholm (SE); Nadia Kylberg, Angsklockevagen 50, S-181 57 Lidingo (SE)

( * ) Notice: Subject to any disclaimer, the term of this patent is extended or adjusted under 35 U.S.C. 154(b) by 0 days.

(21) Appl. No.: 10/030,780

(22) PCT Filed: Jul. 6, 2000

(86) PCT No.: PCT/US00/18572

§ 371 (c)(1),
(2), (4) Date: Jan. 4, 2002

(87) PCT Pub. No.: WO01/01802

PCT Pub. Date: Jan. 11, 2001

Related U.S. Application Data

(60) Provisional application No. 60/142,361, filed on Jul. 6, 1999.

(51) Int. Cl.[7] ..... A41C 3/00
(52) U.S. Cl. ..... 450/41; 450/44
(58) Field of Search ..... 450/41–52

(56) References Cited

U.S. PATENT DOCUMENTS 3,196,460 A * 7/1965 Halstead ..... 450/41
3,351,954 A * 11/1967 Chalfin et al. ..... 450/41
4,298,008 A * 11/1981 Kylberg ..... 450/41

* cited by examiner

*Primary Examiner*—Gloria M. Hale
(74) *Attorney, Agent, or Firm*—Fasth Law Offices; Rolf Fasth

(57) ABSTRACT

The brassiere has a bendable support member disposed therein and a stiffer shock-absorbing resilient member attached to the support member and the brassiere. A woman's breast bends the support member outwardly along the bendable line to a first position and the shock-absorbing resilient member is extended from a rest position to a first extended position and a lower end of the brassiere is pressed against the body. The breast then applies a load on the support member and to bend the support member further outwardly from the first position to a second position and the resilient member is extended from the first extended position to a second extended position. The member and the support member provide a pulling force that is greater than the load of the breast an d the support member is then bent inwardly past the first position and the resilient member is retracted.

9 Claims, 2 Drawing Sheets

BRASSIERE SUPPORT

PRIOR APPLICATIONS

This application is a U.S. national phase application based upon International Application No. PCT/US00/18572, filed Jul. 6, 2000; which claims priority from U.S. Provisional Application No. 60/142,361, filed Jul. 6, 1999.

TECHNICAL FIELD

The present invention relates to a method of using a brassiere including a band-shaped support member made of a bendable supporting material and a stiffer shock-absorbing resilient member.

BACKGROUND AND SUMMARY OF THE INVENTION

Brassiere products have been worn by women for several decades. For example, a brassiere is disclosed in U.S. Pat. No. 4,298,008. One purpose of brassieres, in general, is to reduce the load of the shoulder bands of the brassieres, particularly when the brassieres are used to hold a heavy bust. However, many women still suffer from back and shoulder ache. This is particularly true for women who participate in sports activities and/or have larger sized breasts. Many attempts have been made to solve this problem. For example, sports bras have been developed that hold the breasts very tight to the body. These types of bras are both uncomfortable and make it difficult for the woman to breathe. There is a need for a better solution that provides adequate support and permits normal breathing.

One object of the present invention is to provide an improvement to the previously known constructions that, in addition to reducing the load of the shoulder bands, also supports the breasts from below and distributes any uneven load from the two breasts, and provides the bust, as a whole, with an improved support without impeding the required breathing movements of the diaphragm, and that generally provides the bearer of the brassiere with a better body position.

The brassiere of the present invention thus reduces the load from the shoulder bands, which is an important advantage, especially for women who are involved with heavy work because the load from the shoulder bands often causes the wrong body posture and, thus, other problems related to the shoulders, neck and back. The shoulder bands also often press on the nerves so that parestesies and numbness occur in the arms and hands of the bearer of conventional brassieres. Tests have shown that the loads on the shoulders are reduced by about 80% by using the brassiere according to the present invention, which results in a substantial reduction of the pressure on the plexus brachialis and cervical nerve roots. Another surprising effect of the present invention is that the ligaments of the breasts are not damaged during exercise and other stringent activities.

Conventional brassieres that are only designed to support the front of the breasts, often cause an improper body position of the woman, which is worsened by the tensions from the shoulder bands. Because the support member of the brassiere and the garment of the present invention extend to at least a portion of the back portion the woman's body, position when standing up while using the brassiere is improved. The brassiere of the present invention, therefore, prevents improper body posture.

Conventional brassieres often cause problems for breast-operated women who have a prothesis operated into the breast, because the different loads from the two breasts and the lower tight band of the conventional brassieres often wear and irritate the scar of the surgery. There is also a substantial risk for such surgically-operated women to develop lymphodem, which is substantially worsened if the patient carries a brassiere with a large load from the shoulder bands and support bands that are located below the breasts. This risk is thus reduced by the brassiere of the present invention and, because the support member extends from the middle portion of the brassiere to at least a portion of the back portion and the brassiere also, with the exception of the cups, is, preferably, made of an elastic material so that the loads from the breasts are evenly distributed and prevents any unnecessary pain from the surgical scar. Of course, other suitable elastic and un-elastic materials may be used, depending upon the needs of the female users. Also, the cups may be made of a flexible material, if desired.

The brassiere of the present invention also provides the bust, as a whole, with a very good support and is, therefore, suitable for sport activities, especially sports and other physical movements that cause the breasts to move up and down, such as running, aerobics, horse-back riding, tennis soccer and other sports. It is important to properly support the breasts to prevent unnecessary damage to ligaments resulting from jumping and pushing. Because the elastic material and the cups are cut so that a portion of the elastic material between the cups substantially has the shape of an "upside-down V", the movement of the diaphragm is not impeded noticeably; that is, the breathing is not impeded either. Conventional brassieres have stiff bands that extend over this area and hindered breathing.

According to a preferred embodiment of the brassiere of the present invention, a transverse edge of an end portion of the support member that is turned towards the mid-portion of the brassiere is sloped across at least a portion of the width of the support member. In this way, when the transverse edges of the support members are engaging one another at the middle portion of the brassiere, they form an "upside-down V". This further promotes the free movement of the diaphragm because the support members do not substantially bear against the diaphragm. Furthermore, the support member does not have any protruding corners that may penetrate into the body fat, such as when the woman bends forward, and the support member generally adapts better to the shape of the body and breasts.

The support members are, preferably, disposed in their own pockets formed in the brassiere. The support member may move a certain extent within each pocket which enables them to smoothly follow the movements of the body and may make such movement easier rather than prevent such movement. Because the support member is not completely fixated, the member is permitted to support and lift the breast in a positive way that gives the bearer of the brassiere great freedom of movement.

The transverse edge of the support member may be provided with a guide device that ensures correct position in the brassiere. It is very important that the support member is in the correct position in the brassiere and, thus, relative to the body of the bearer so that the function is satisfactory. If the support members are misplaced, they do not provide the breasts with the intended support.

More particularly, the support member of the present invention is disposed in each half of the brassiere from an area at a middle point thereof and in a direction towards the back portion of the brassiere. The member is foldable along a longitudinal line that partly extends mainly along a bottom edge of the cup of the half portion of the brassiere so that the use of the portion of the band-shaped support member that is disposed on one side of the line supports the underside of the breast while being support by the other portion that is disposed under the breast and bears against the body of the bearer of the brassiere. The band-shaped member has transverse slits defined therein along the edges of the member so that the support member may adapt to the shape of the breast and the body.

More particularly, the brassiere has a bendable support member disposed therein and a stiffer shock-absorbing resilient member attached to the support member and the brassiere. A woman's breast bends the support member outwardly along the bendable line to a first position, and the shock-absorbing resilient member is extended from a rest position to a first extended position, and a lower end of the brassiere is pressed against the body. The breast then applies a load on the support member and to bend the support member further outwardly from the first position to a second position and the resilient member is extended from the first extended position to a second extended position. The member and the support member provide a pulling force that is greater than the load of the breast and the support member is then bent inwardly past the first position, and the resilient member is retracted.

BRIEF DESCRIPTION OF THE DRAWINGS

In order to explain the invention in more detail, an exemplary embodiment of the brassiere of the present invention will now be described in more detail, with reference to the attached drawings of which.

DETAILED DESCRIPTION

Figure 1:
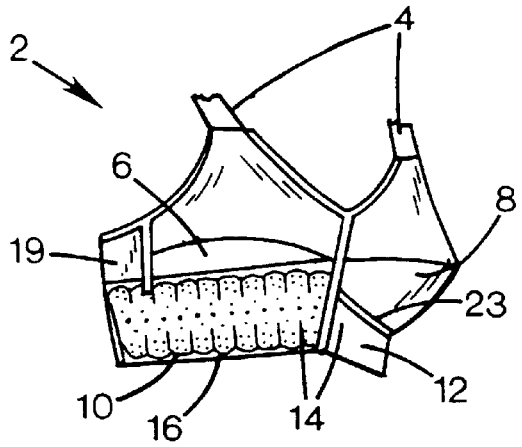
FIG. 1 shows a front view of the brassiere of the present invention with the support member indicated in one of the brassiere halves.

With reference to FIGS. 1–4 the present invention has a front portion of a brassiere 2 that has shoulder bands 4 and cups 6, 8 to comfortably hold the breasts of a woman. Elastic support portions 10, 12 disposed below the cups 6, 8 are made of an elastic material, for example an elastic material that is sold by Piave under the trademark TOPTEX®. The cups 6, 8 may be made of a non-flexible fabric or of a flexible material.

The elastic support portions 10, 12 and the cups 6, 8 are preferably cut so that the elastic support portion extend up into an area to form a substantially "upside-down V" in a middle portion 14 disposed between the cups 6, 8. In this way, the diaphragm of the woman using the brassiere 2 may freely move during breathing.

An elongate band-shaped support member 16 is disposed in each half of the brassiere. Preferably, the support member 16 is sewn into a protective bag 17 to further protect the brassiere 2 and the support member 16. The support member 16 may extend from an area at the middle portion 14 of the brasserie 2 toward a back portion 19 of the brassiere 2. Preferably, at least ⅔ or more of a length of the support member 16 is disposed in the support portions 10, 12 to optimize the support of the breasts disposed in the cups 6, 8.

The support member 16 is bendable along a middle portion 21 and is positioned in such a way in the brassiere 2 that the middle portion 21 extends substantially along a lower edge 23 of the cups 6, 8. Preferably, the support member 16 is thickest in the middle portion 21 to provide sufficient supporting effect. In this way, the support member 16 may, when the brassiere 2 is used to hold the breasts, adapt itself to the curved transition area between the underside of the breasts and the body along the lower edge 23. A plurality of holes 25 are disposed along the middle portion 21 to provide adequate ventilation through the support member 16.

The support member 16 is, preferably, made of a bendable but relatively stiff plastic material, or any other suitable material, that is used within the health-care industry. The material should not emit any harmful matters. A 100% polyethylene material has shown to be a suitable plastic material but other suitable materials and plastics may also be used.

The support member 16 and the bag 17 are removably inserted in a pocket disposed between an inner lining and an outer fabric of the brassiere 2. The support member 16 is not rigidly disposed but has some movability within the pocket which enables the support member 16 and a member 106 to smoothly follow the movements of the body and the breasts, as explained in detail below, to hold the breasts as still as possible. Because the support member 16 has some movability, it will support and lift the breasts in a positive way that provides the bearer of the brassiere 2 great freedom of movement.

Because the support member 16 extends backwardly to the back portion 19 and across the back side of the brassiere 2, the support member 16 will also hold the back of the bearer of the brassiere 2 and contribute to a generally better carriage of the bearer. In contrast, in the case of conventional brassieres, they are only focused on holding the front of the breasts. The brassiere 2 of the present invention, thus, prevents bad carriage of the bearer while conventional brassieres, that has their weight held up by shoulder bands, often worsen an already bad carriage.

Figure 2:
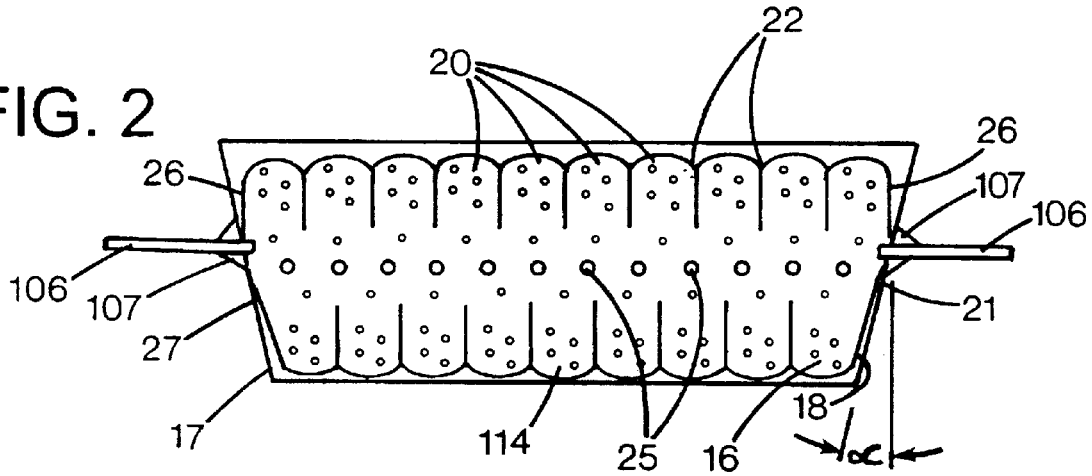
FIG. 2 shows a plane view of the support member of the present invention.

A transverse edge 18 of the support member 16, particularly the end that is turned towards the middle portion 14 of the brassiere 2, extends at an inclined angle alpha relative to a vertical edge end portion 26, see FIG. 2. The transverse edges 18 of two support members that are turned towards each other and to the middle portion 14, therefore, reduce a gap that may be formed between the support members 16 and has the form of a substantially "upside-down V". In this way, the support member 16, preferably, allows for free movement of the diaphragm disposed between the cups 6, 8 below the brassiere 2, so that the breathing can be performed without much hinderance from the brassiere 2. This makes the brassiere 2 of the present invention particularly suitable for sports, song and other activities requiring heavy and/or efficient breathing. The support member 16 does, therefore, not have any protruding corners in the middle portion 14 that could stick out from the brassiere 2 and penetrate into the body fat when the bearer bends forward. The inclined edge 18 of the support member 16 has turned out to effectively follow the body and provide a better distribution of a set of movable flaps 20 of the support member 16 so that support member generally provides a better support for the breast.

As shown in FIG. 2, a set of slits 22 are defined along the edges of the support member 16. The slits extend in a direction that is perpendicular to the elongate support member 16 and a portion across the width of the support member 16 so that the individual flaps 20 are formed along each side of the support member 16. In this way, the support member 16 may be bent and adjusts itself to the shape of the body, and the relatively round shape of the breasts, in a smooth manner, without forming uncomfortable protrusions.

To provide complete support of the breast, the flaps 20 should be able to spread out and conform to the shape of the breasts to be supported. The bendability of the support member 16 is made easier because the portions 10, 12 are made of an elastic material. If the portions 10, 12 were made of an un-elastic material, then the flaps 20 could be forced together and would not be able to spread out in a simple way to adjust themselves to the shape of the body and the breasts.

Figure 4:
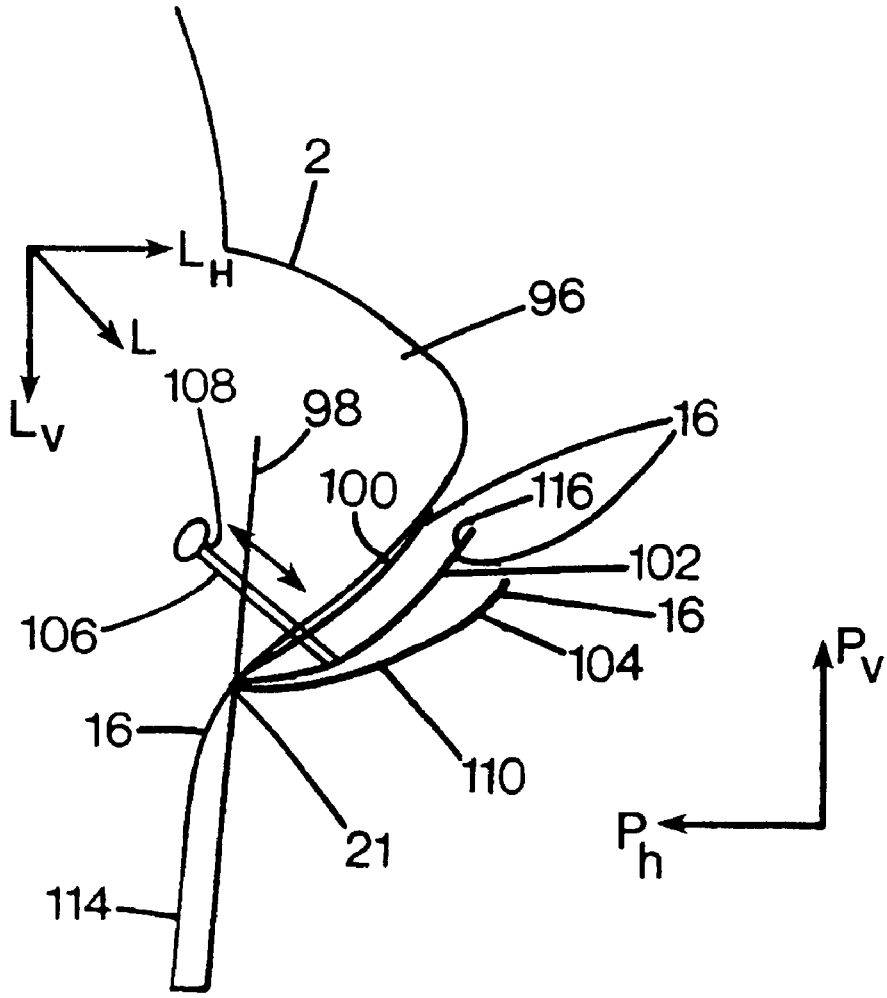
FIG. 4 is schematic side view of the support member in different positions.

The support member 16 has further a number of ventilation openings 24 defined in the flaps 20 and along the middle portion 21 of the support member 16. The openings 25 are slightly larger than the ventilation openings 24 because the openings 25 provide for increased ventilation along the folding line at the middle portion 21 of the support member 16. When the brassiere 2 is used, the support member 16 may thus be bent along this folding line 21 so that its upper part in FIG. 2 may bear against the under side of the breast while its lower part bears against the body, as best shown in FIG. 4 and described in detail below.

It is very important that the support member 16 is correctly positioned inside the brassiere 2 and for this reason elastic members 106 are attached to the edges 26 at connection points 107 to enable the proper mounting of the support members in the correct position. The connection points 107 may be a protruding flap having openings defined therein to receive the members 106. As described below, the member 106 also provides a surprisingly good and important shock-absorbing function. The members 106 provide an unexpected increase in support and absorption of shock. Even a slightly incorrect position of the support members 16 in the brassiere 2 may substantially reduce the effective lifting and supporting function of the support members 16.

The brassiere of the present invention may also be included in clothing, such as sun dresses, gymnastic and sports clothing, swim dresses, body stockings, and other similar clothing.

Figure 3:
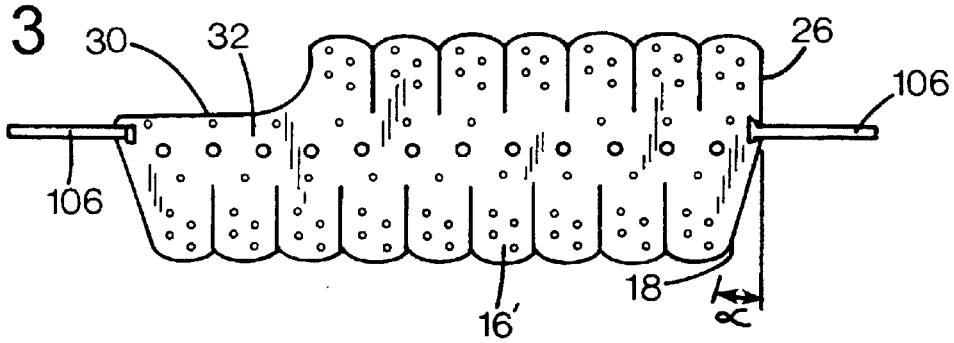
FIG. 3 is a plane view of an alternative embodiment of the support member of the present invention.

FIG. 3 shows an alternative embodiment of the support member of the present invention. The support member 16' has a reduced width segment 30 at a rear end 32 of the support member 16' that provides extra comfort for the user of the brassiere to increase the use of the invention.

FIG. 4 illustrates a schematic side view of the support member 16 in three bent positions 100, 102 and 104 compared to a vertical rest position 98 when the brassiere 2 is not in use. The positions 100, 102 and 104 illustrate the various positions of the support member 16 to compensate for any up and down movement of the woman's body when the woman is, for example, running or moving about in a very active manner. More specifically, when a woman is, for example, running, the body is moving up and down due to the impact of the foot on the road and the movement is transferred to the breasts.

The brassiere cup 96, as shown in FIG. 4, of the brassiere 2 holds the breast on an inside of the cup 96. The brassiere 2 of the present invention has one end 108 of the shock-absorbing flexible member 106 attached to an inside fabric of the brassiere 2 and an opposite end 110 attached to the edge 26 at a rear end 27 of the support member 16. The members 106 ensure that the support member 16 is correctly positioned within the brassiere 2 and functions as a shock absorber to absorb any up and down movement of the body due to the impact that is created when the foot hits the ground or pavement.

An important function of the support member 16 is to act as a spring that cooperates with the shock-absorbing characteristics of the member 106 to hold the breast still although the woman may be running. More particularly, the support member 16 is bendable at the middle portion 21 of the support member 16 due to the weight of the breast. As best seen in FIG. 3, the middle portion 21 should be about half way up from a lower edge of the support member 16. Preferably, the middle portion 21 is reinforced to prevent the support member 16 from completely folding due to the downward forces of the breasts. The thickness of the support member 16 may be made thicker at the middle portion 21 to provide extra support. It is also possible to use varied thicknesses on the support member 16 and different stiffness of the flaps 20 and the members 106 so that the stiffness and support properties of the entire brassiere may be adjusted to the specific needs of the user. The connection points 107 should be about ⅔ of the way up from the lower edge of the support member 16 so that the connection points 107 are located on the upper section 116. It is important that there is a distance between the connection points 107 and the middle portion 21, i.e., that the connection points 107 are disposed at a higher level than the middle portion 21 because when the support member 16 is, for example, exposed to a great downward force, the members 106 prevent the upper section 116 of the support member 16 from bending too much. If the support member 16 is bent too much about the middle portion 21, then the support member does not provide the desired support to the breast and the breast may bounce downwardly, which may damage ligaments and other parts. Also, if the upper section 116 is permitted to bend too much, a dangerous edge may be formed along the middle portion 21 that could severely damage the breast. The support section may even break along the middle portion. Because the members 106 are stiffer than the support member 16, the members act as a shock absorber and stop any excessive bending of the upper portion 116 about the middle portion 21 while the upper portion 116 has a springing effect to accommodate minor up and down movements of the body and the breasts.

When the woman is standing still, the support member may be in the second position 102. The support member 16 may move between the position 100 and 104 to hold the breast as still as possible when the woman is running, which causes the body to move up and down. The running motion of the body translates into a vertical load component $L_v$ and a horizontal load component $L_h$ of the breast. When the body is moved downwardly, the support member 16 may move into the position 100 so that the breast is permitted to remain stationary while the body moves downwardly. Similarly, the support member 16 may move from the high position 100 to the low position 104 when the body is moving up, to minimize any up and down movement of the breasts and to smooth out the movements of the breasts.

Correspondingly, the elastic member 106 acts as a shock absorber and may stretch somewhat from the rest position 102 to the extended position 104 and may then be retracted to the position 100 to compensate for any up and down movement of the body. As mentioned above, the elongate member 106 is, preferably, stiffer than the bendability of the support member 16 to further minimize any up and down movement of the breasts. The elastic member 106 mainly provides a horizontal pulling force $P_h$ when the brassiere reaches, for example, the lower position 104 while the support member 16 provides a vertical pulling force $P_v$.

A lower end 114 of the support member 16 may be pressed against the body of the women below the breasts as the support member 16 pivots about the middle portion 21 while an upper end 116 is bendable to keep the breast as still as possible as the remaining part of the body is moving up and down. Because upper end 116 conforms to the shape of the breast held inside the breast cup 98, the pressure is evenly distributed over the entire lower part of the breast. Only about 20% of the load is carried by the shoulder bands while the remaining 80% of the load is evenly distributed by the brassiere's lower parts around the breasts and the back. In contrast to sport bras, there is no need to tightly hold the breasts, which inhibits the breathing of the woman, or to have a very tight or stiff band below the breasts that is both uncomfortable and inhibiting.

While the present invention has been described in accordance with preferred compositions and embodiments, it is to be understood that certain substitutions and alterations may be made thereto without departing from the spirit and scope of the following claims.

We claim:

1. A method of using a brassiere device on a woman's body having a breast, comprising:

(a) providing a brassiere (2) having a bendable support member (16) disposed therein, a shock-absorbing resilient member (106) having one end attached to an inside of the brassiere (2) and an opposite end attached to the support member (16) and the resilient member (106) being stiffer than the bendable support member (16), the support member (16) having a bendable line (21) extending along the support member (16) and transverse slits (22) formed along longitudinal edges of the support member;

(b) placing the breast inside the brassiere (2) and bending the support member (16) outwardly along the bendable line (21) to a first position (100) relative to the body so that the breast is being supported by the support member (16);

(c) extending the shock-absorbing resilient member (106) from a rest position to a first extended position;

(d) pressing a lower end (114) of the brassiere (2) against the body;

(e) the breast applying a load (L) on the support member (16) and bending the support member (16) outwardly from the first position (100) to a second position (102), the load (L) having a horizontal component ($L_h$) and a vertical component ($L_v$);

(f) extending the resilient member (106) from the first extended position to a second extended position;

(g) while in the second extended position, the resilient member (106) providing a horizontal pulling force ($P_h$) that is being greater than the horizontal component ($L_h$) of the load (L) of the breast and the support member (16) providing a vertical pulling force ($P_v$) that is being the vertical component ($L_v$) of the load (L) of the breast; and (h) bending the support member (16) inwardly from the second position (102) passed the first position (100) and retracting the resilient member (106).

2. The method according to claim 1 wherein step (a) further comprises placing the support member (16) in a protective bag (17) that is slidably disposed inside the brassiere (2).

3. The method according to claim 1 wherein the method further comprises providing the support member (16) with flaps (20) and spreading out the flaps (20) to conform the flaps (20) to a shape of the breast.

4. The method according to claim 1 wherein the method further comprises connecting the resilient member (106) at a connection point (107) of the support member (16).

5. The method according to claim 1 wherein step (a) further comprises the step of providing the support member (16') with a reduced width segment (30).

6. The method according to claim 1 wherein the method further comprises releasing a pressure provided by the lower end (114) against the body.

7. The method according to claim 1 wherein the method further comprises providing the support member (16) with a plurality of flaps (20) having different stiffness.

8. The method according to claim 1 wherein step (a) further comprises providing the support member (16) with a slanted short edge (18).

9. The method according to claim 1 wherein the bendable line (21) is disposed in the middle of the support member (16) and the resilient member (106) is attached about ⅔ up from a lower edge of the support member (16).

* * * * *